US011256194B2

(12) United States Patent
Tsuchiya et al.

(10) Patent No.: US 11,256,194 B2
(45) Date of Patent: Feb. 22, 2022

(54) DEVELOPING DEVICE, PROCESS CARTRIDGE, AND IMAGE FORMING APPARATUS

(71) Applicant: Ricoh Company, Ltd., Tokyo (JP)

(72) Inventors: Yuuki Tsuchiya, Tokyo (JP); Yoshihiro Fujiwara, Kanagawa (JP); Yuki Oshikawa, Kanagawa (JP); Ryusuke Mase, Kanagawa (JP); Naohiro Kawashima, Kanagawa (JP); Hotaru Hashikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/934,218

(22) Filed: Jul. 21, 2020

(65) Prior Publication Data

US 2021/0041806 A1 Feb. 11, 2021

(30) Foreign Application Priority Data

Aug. 9, 2019 (JP) ..... JP2019-147500

(51) Int. Cl.
*G03G 15/08* (2006.01)
*G03G 15/09* (2006.01)

(52) U.S. Cl.
CPC ..... *G03G 15/0891* (2013.01); *G03G 15/0935* (2013.01)

(58) Field of Classification Search
CPC ..... G03G 15/0891; G03G 15/0935
See application file for complete search history.

(56) References Cited

U.S. PATENT DOCUMENTS

| | | | | |
|---|---|---|---|---|
| 8,417,173 | B2 * | 4/2013 | Sakuma | G03G 21/12 399/360 |
| 2010/0215401 | A1 | 8/2010 | Fujiwara et al. | |
| 2012/0207492 | A1 | 8/2012 | Fujiwara et al. | |
| 2013/0045029 | A1 | 2/2013 | Kimura et al. | |
| 2013/0064570 | A1 | 3/2013 | Yamane et al. | |
| 2014/0270838 | A1 | 9/2014 | Yoshizawa et al. | |
| 2014/0376970 | A1 | 12/2014 | Kimura et al. | |
| 2015/0362861 | A1 | 12/2015 | Oshikawa et al. | |
| 2016/0195846 | A1 | 7/2016 | Koshizuka et al. | |
| 2017/0293257 | A1 | 10/2017 | Ohhira et al. | |

(Continued)

FOREIGN PATENT DOCUMENTS

| | | | |
|---|---|---|---|
| JP | 2004-045563 | * | 2/2004 |
| JP | 2008-256917 | | 10/2008 |

(Continued)

OTHER PUBLICATIONS

Machine translation of Description JP 2004-045563 (Year: 2004).*

*Primary Examiner* — Arlene Heredia
(74) *Attorney, Agent, or Firm* — Xsensus LLP

(57) ABSTRACT

A developing device includes a developer conveyer, a bearing, a flange, and a developer mover. The developer conveyer is rotatable and configured to convey a developer. The bearing rotatably supports a support shaft of the developer conveyer. The flange is disposed at an end portion of the developer conveyor to regulate a movement of the developer in an axial direction of the developer conveyer. The developer mover is disposed on a surface of the flange facing the bearing and configured to move the developer that enters between the flange and the bearing.

15 Claims, 4 Drawing Sheets

(56) References Cited

U.S. PATENT DOCUMENTS

| | | | | |
|---|---|---|---|---|
| 2018/0136586 | A1 | 5/2018 | Tsuchiya et al. | |
| 2018/0143568 | A1 | 5/2018 | Ohhira et al. | |
| 2019/0018343 | A1 | 1/2019 | Oshikawa | |
| 2020/0103824 | A1 | 4/2020 | Oshikawa et al. | |
| 2020/0117119 | A1 | 4/2020 | Mase et al. | |
| 2020/0174400 | A1 | 6/2020 | Kawashima et al. | |
| 2020/0363130 | A1* | 11/2020 | Taguchi ..... | F27B 9/32 |

FOREIGN PATENT DOCUMENTS

| | | |
|---|---|---|
| JP | 2010-164799 | 7/2010 |
| JP | 2011-186222 | 9/2011 |

* cited by examiner

DEVELOPING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119 to Japanese Patent Application No. 2019-147500, filed on Aug. 9, 2019 in the Japan Patent Office, the entire disclosure of which is hereby incorporated by reference herein.

BACKGROUND

Technical Field

This disclosure generally relates to a developing device, a process cartridge, and an image forming apparatus, such as a copier, a printer, a facsimile machine, or a multifunction peripheral (or multifunction machine) having at least two of copying, printing, facsimile transmission, plotting, and scanning capabilities.

Background Art

Generally, electrophotographic image forming apparatuses such as copiers, printers, facsimile machines, or multifunction machines including those capabilities include a developing device that uses two-component developer including toner and carrier to develop and visualize an electrostatic latent image formed on an image bearer. The developing device includes a developing roller bearing the developer, a supply screw to supply and correct the developer, a stirring screw to stir the developer, and a paddle portion disposed between the supply screw and the stirring screw. The paddle portion exchanges the developer between the supply screw and the stirring screw.

SUMMARY

This specification describes an improved developing device that includes a developer conveyer, a bearing, a flange, and a developer mover. The developer conveyer is rotatable and configured to convey a developer. The bearing rotatably supports a support shaft of the developer conveyer. The flange is disposed at an end portion of the developer conveyor to regulate a movement of the developer in an axial direction of the developer conveyer. The developer mover is disposed on a surface of the flange facing the bearing and configured to move the developer that enters between the flange and the bearing.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
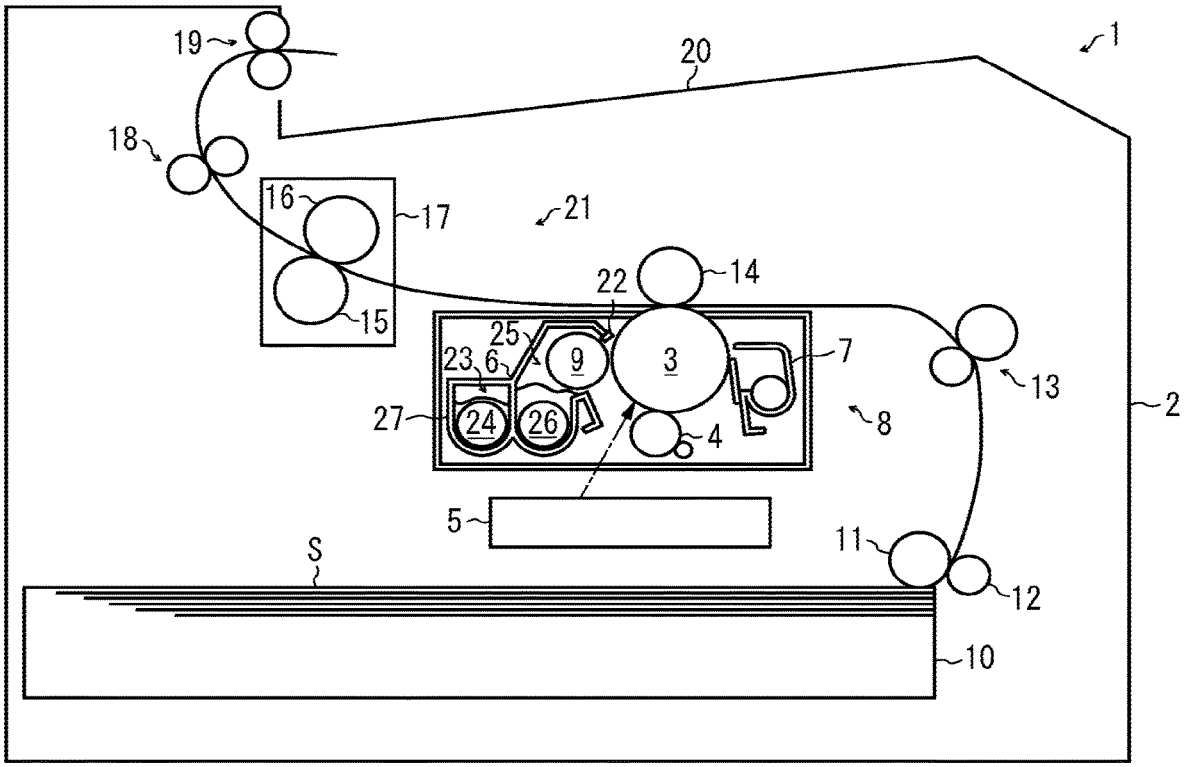
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

FIG. 1 is a schematic view illustrating an image forming apparatus according to an embodiment of the present disclosure. In FIG. 1, a printer 1 that is a monochrome image forming apparatus includes a rotatable photoconductor drum 3 as an image bearer inside a main body 2 of the printer 1. Around the photoconductor drum 3, the printer 1 includes a charging roller 4 as a charger to uniformly charge the surface of the photoconductor drum 3, an exposure device 5 that exposes the charged surface of the photoconductor drum 3 to form an electrostatic latent image, a developing device 6 to supply toner to the electrostatic latent image formed on the surface of the photoconductor drum 3 and perform a developing. In addition, around the photoconductor drum 3, the printer 1 includes a toner cartridge accommodating toner of a developer to supply the developing device 6, a cleaner 7 to remove a residual toner failed to transfer from the surface of the photoconductor drum 3, and a discharger to discharge the surface of the photoconductor drum 3 to initialize the surface of the photoconductor drum 3. The photoconductor drum 3, the charging roller 4, the exposure device 5, the developing device 6, the toner cartridge, the cleaner 7, and the discharger are configured as one unit, that is, a process cartridge 8. The process cartridge 8 is removably installable in the main body 2 of the printer 1.

The developing device 6 includes a developing roller 9 that is arranged close to the surface of the photoconductor drum 3 and supplies toner to the surface of the photoconductor drum 3. A developing bias power supply applies a negative potential bias voltage to the shaft of the developing roller 9. Similarly, a charging bias power supply applies a negative potential bias voltage to the charging roller 4.

As the photoconductor drum 3 rotates, the cleaner 7 scrapes off a residual toner failed to transfer from the surface of the photoconductor drum 3, and a conveyance device conveys the scraped residual toner to a collection container. After the cleaner 7 cleans the surface of the photoconductor drum 3, the discharger discharges the surface of the photoconductor drum 3, and the charging roller 4 uniformly charges the surface of the photoconductor drum 3 to a high potential. After that, the exposure device 5 selectively exposes the surface of the photoconductor drum 3 that is uniformly charged to the high potential based on image data to form an electrostatic latent image having a low potential portion in which the high potential is attenuated by the exposure and a high potential portion that is not exposed. Subsequently, the developing device 6 transfers toner to the low potential portion formed as described above. As a result, the electrostatic latent image is visualized as a toner image.

In a lower portion of the main body 2 of the printer 1, the printer 1 includes a sheet feeding tray 10 that stores a plurality of sheets S as recording media, a feed roller 11 to feed a sheet S from the sheet feeding tray 10, and a separation roller 12 to separate the sheet one by one from the sheets S fed from the sheet feeding tray 10. Downstream from the feed roller 11 in a sheet conveyance direction, a registration roller pair 13 is disposed to convey the sheet S.

At a position facing the photoconductor drum 3 via the sheet conveyance passage, the transfer roller 14 is disposed to transfer the toner image formed on the photoconductor drum 3 to the sheet S. Downstream from the transfer roller 14 in the sheet conveyance direction, a fixing device 17 having a heating roller 15 and a pressure roller 16 is arranged.

Downstream from the fixing device 17 in the sheet conveyance direction, the printer 1 includes a conveyance roller pair 18 to convey the sheet S on which the toner image is fixed, an ejection roller pair 19 to eject the sheet S from the printer 1, and an ejection tray 20 to stack the ejected sheets S.

In the above configuration, an image forming section 21 to form an image is configured by the process cartridge 8, the transfer roller 14, and the fixing device 17.

The above-described processes form the toner image on the surface of the photoconductor drum 3, and the feed roller 11 and the separation roller 12 rotate to feed one sheet S from the sheet feeding tray 10. The sheet S fed from the sheet feeding tray 10 is conveyed to the registration roller pair 13. The registration roller pair 13 rotates at a predetermined timing to feed the sheet S between the photoconductor drum 3 and the transfer roller 14.

The transfer roller 14 presses the sheet S fed from the registration roller pair 13 against the photoconductor drum 3 and applies a transfer bias to the sheet S to transfer the toner image formed on the photoconductor drum 3 onto the sheet S. After the toner image is transferred onto the sheet S, the sheet S is sent to the fixing device 17 in which heat and pressure fix the toner image to the sheet S. After the toner image is fixed to the sheet S, the conveyance roller pair 18 conveys the sheet S, and the ejection roller pair 19 ejects the sheet S onto the ejection tray 20.

Next, the developing device 6, which is a feature of the present embodiment, is described with reference to FIGS. 1 and 2. The developing device 6 includes a developing roller 9, a doctor blade 22, a collecting screw 24, a supply screw 26, and a toner concentration sensor. In addition, the developing device 6 includes a partition wall 35 that divides the developer container of the developing device 6 into a first developer container 23 and a second developer container 25. The first developer container 23 and the second developer container 25 contain a two-component developer including toner and carrier. Outside both ends of the partition wall 35, the developing device 6 has a first communication opening 36 and a second communication opening 37 that communicate between the first developer container 23 and the second developer container 25. The toner concentration sensor detects the concentration of toner in the developer. The developing roller 9 faces the surface of the photoconductor drum 3.

A magnet is fixed inside the developing roller 9. The developing roller 9 includes a sleeve rotatable around the magnet. A free end of the doctor blade 22 faces the surface of the developing roller 9. The collecting screw 24 as a developer conveyor is also referred to as a first screw or a first developer conveyor and disposed in the first developer container 23 to convey the developer in the first developer container 23. The supply screw 26 as a developer conveyor is also referred to as a second screw or a second developer conveyor and disposed in the second developer container 25 to convey the developer in the second developer container 25.

A description is provided of a developing operation performed by the developing device 6.

A magnetic field of the magnet in the developing roller 9 attracts the developer onto the developing roller 9. The developing roller 9 rotates clockwise in FIG. 1 to move the developer. The toner concentration of the developer in the developing device 6 is adjusted to be within a predetermined range. Specifically, according to toner consumption in the developing device 6, toner is replenished from the toner cartridge to the first developer container 23 via a replenishment path.

After the toner is replenished to the first developer container 23, the collecting screw 24 and the supply screw 26 stir the developer to mix the toner with the developer and circulate the developer in the first developer container 23, the first communication opening 36, the second developer container 25, and the second communication opening 37. The toner in the developer is charged by friction with the carrier and attracted to the carrier. The magnetic force formed on the developing roller 9 attracts the carrier with toner on the developing roller 9. As a result, the developing roller 9 bears the developer.

Rotation of the developing roller 9 transports the developer beard on the developing roller 9 to a position facing the doctor blade 22 where the amount of the developer is adjusted by the doctor blade 22 and further transports the developer to a development area facing the photoconductor drum 3. An electrical field formed in the development area causes the toner to adhere to the electrostatic latent image formed on the photoconductor drum 3. After that, the rotation of the developing roller 9 moves the developer to the first developer container 23, and the developer is released from the developing roller 9 to the first developer container 23.

Figure 2:
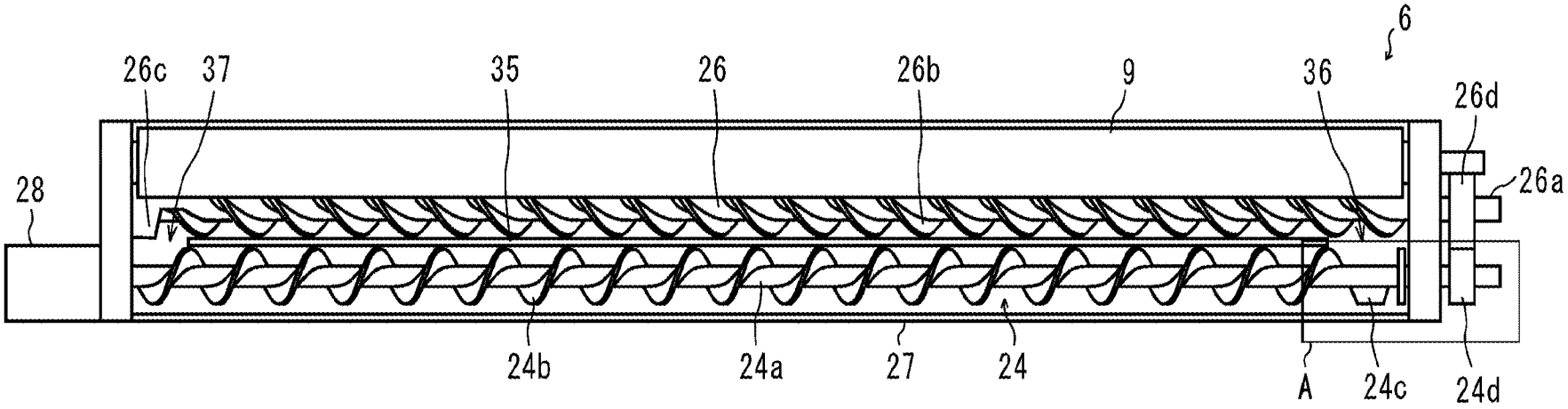
FIG. 2 is a schematic view illustrating a configuration of a developing device according to the embodiment of the present disclosure.

FIG. 2 is a schematic view illustrating the developing device 6 viewed from an upper side in FIG. 1. In FIG. 2, a part of a developing case 27 including an outer wall of the developing device 6 is eliminated. Inside the developing case 27, the developing roller 9, the collecting screw 24, and the supply screw 26 are rotatably arranged.

The collecting screw 24 includes a support shaft **24*a* and a screw portion 24*b* around the support shaft 24*a* that are formed as one unit. The collecting screw 24 receives a driving force from a motor and rotates to stir the developer and convey the developer from left to right in FIG. 2. The collecting screw 24 includes a paddle portion 24*c* delivering the conveyed developer to the supply screw 26 and provided integrally with the support shaft 24*a* near the right end portion of the collecting screw 24 that is an end portion downstream in a conveyance direction in which the collecting screw 24 conveys the developer. A drive gear 24***d* is disposed at the right shaft end of the support shaft 24*a* to transmit the driving force. The collecting screw 24 collects the developer released from the circumferential surface of the developing roller 9 and conveys and stirs the developer to mix with new toner supplied from the toner cartridge to a toner supply port 28 in FIG. 2.

The supply screw 26 includes a support shaft 26*a* and a screw portion 26*b* around the support shaft 26*a* that are formed as one unit. The supply screw 26 receives a driving force from a motor and rotates to stir the developer and convey the developer from right to left in FIG. 2. The supply screw 26 includes a paddle portion 26*c* delivering the conveyed developer to the collecting screw 24 and provided integrally with the support shaft 26*a* near the left end portion of the supply screw 26. A drive gear 26*d* is disposed at the right shaft end of the support shaft 26*a* to transmit the driving force. The supply screw 26 supplies the charged developer to the circumferential surface of the developing roller 9 while conveying and stirring the developer conveyed from the collecting screw 24.

Figure 3:
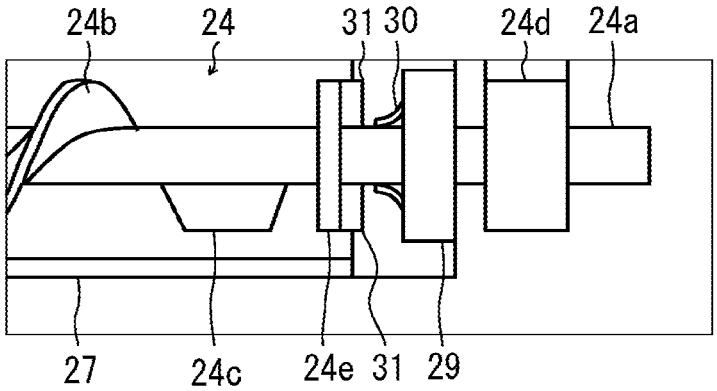
FIG. 3 is a schematic view illustrating a main part of the developing device according to the embodiment of the present disclosure.

FIG. 3 is an enlarged view illustrating a part A of the developing device 6 in FIG. 2 to describe the feature of the present embodiment. FIG. 3 illustrates the part A in which a part of the developing case 27 is eliminated.

As illustrated in FIG. 3, the end portion of the support shaft 24*a* is rotatably supported by a bearing 29 fixed to the developing case 27. Between the bearing 29 and the support shaft 24*a*, a seal 30 is disposed to prevent foreign matter such as toner and dust from entering the bearing 29.

The flange 24*e* that is configured as one unit with the support shaft 24*a* is disposed between an end portion of the collecting screw 24 supported by the bearing 29 and the paddle portion 24*c* to prevent the developer conveyed from left to right in FIG. 3 by rotation of the screw portion 24*b* from being conveyed to the bearing 29, that is, to restrict movement of the developer in an axial direction. In the present embodiment, the flange 24*e* is arranged so that the flange 24*e* does not protrude from the developing case 27 and does not interfere with the developing case 27. However, even when the above-described flange 24*e* is disposed, the developer enters a space between the flange 24*e* and the bearing 29. The developer that has entered loses its flowability and is likely to become an accumulated developer that does not move from the space. The accumulated developer is heated by sliding friction between the bearing 29 and the seal 30 and causes abnormal images such as a white streak.

The following is a description of a configuration according to a first embodiment of the present disclosure that solves the above-described problem.

A feature of the present embodiment is a paddle 31 as a developer mover disposed on a surface of the flange 24*e* that is toward outside, that is, the right end surface of the flange 24*e* in FIG. 3, the end surface of the flange 24*e* facing the driving gear 24*d*, the end surface of the flange 24*e* toward the outside of the developing device 6, or the surface of the flange 24*e* facing the bearing 29. The paddle 31 is a ridge formed on the surface of the flange 24*e* facing the bearing 29 and is integrally formed with the flange 24*e* in the present embodiment. Alternatively, the paddle 31 may be integrally fixed to the flange 24*e* by adhesion, welding, screwing or the like.

Figure 4:
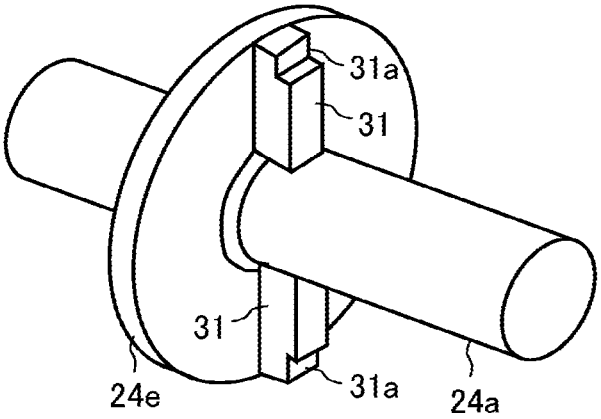
FIG. 4 is a schematic view illustrating a flange and a paddle used in a first embodiment of the present disclosure.

In the present embodiment, as illustrated in FIG. 4, two paddles 31 are provided and radially formed from the axis of the support shaft 24*a* to face each other, that is, to be arranged in a straight line. The paddle 31 has a cutout 31*a* at the tip corner. The bearing 29 has a recess at a central portion of the bearing 29, and the developer is likely to accumulate in the recess. Therefore, the paddle 31 has the cutout 31*a* at the tip corner that is the tip of the outer circumferential portion of the paddle 31 to avoid the outer circumferential portion of the bearing 29 and be able to work in the central portion of the bearing 29. The above-described configuration can enter the paddle 31 in the central portion of the bearing 29. However, preferably, the paddle 31, that is, the cutout 31*a* is formed not to contact the seal 30.

According to the above configuration, since the paddle 31 disposed on the outer surface of the flange 24*e* toward the outside of the developing device 6 rotates with the support shaft 24*a*, the paddle 31 can scrape off the developer that enters the space between the flange 24*e* and the bearing 29 and prevent the occurrence of the accumulated developer and abnormal images such as the white streak. The above configuration includes two paddles 31, but the developing device 6 may include at least one paddle 31 or three or more paddles 31. Although the paddle 31 is integrally formed with the flange 24*e*, the paddle 31 may be integrally fixed to the flange 24*e*. Any configuration may be adopted as long as the paddle 31 is fixed to the flange 24*e* by a well-known method such as screwing, adhesion, or welding.

Figure 5:
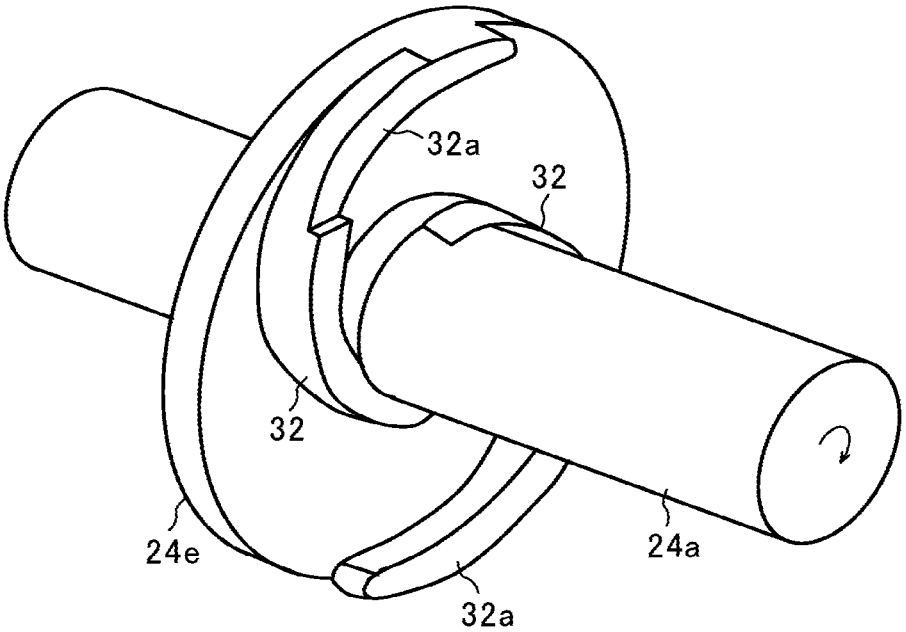
FIG. 5 is a schematic view illustrating a flange and a paddle used in a second embodiment of the present disclosure.

FIG. 5 illustrates a second embodiment of the present disclosure. The second embodiment is different from the above-described first embodiment in that paddles 32 are used instead of the paddles 31, and other configurations are the same.

The paddles 32 are two paddles 32 facing each other. Each of the paddles 32 has a curved shape that is curved to have a spiral shape around the support shaft 24*a*. As illustrated in FIG. 5, the support shaft 24*a* is configured to rotate in a rotation direction indicated by an arrow. The paddle 32 moves so that a concave curved surface moves the developer in the rotation direction of the support shaft 24*a*. The paddle 32 has the cutout 32*a* at the tip corner to avoid contact with the outer circumferential portion of the bearing 29.

According to the above-described configuration, since the paddle 32 has the curved shape, the mobility of the developer can be improved as compared with the paddle 31, and the paddle 32 can more satisfactorily scrape out the developer entering the space between the flange 24*e* and the bearing 29. As a result, the paddle 32 can further prevent the occurrence of abnormal images.

Also, in the second embodiment, the developing device 6 may include at least one paddle 32 or three or more paddles 32. In addition, any configuration may be adopted as long as the paddle 32 is fixed to the flange 24*e* by a well-known method such as screwing, adhesion, or welding.

Figure 6:
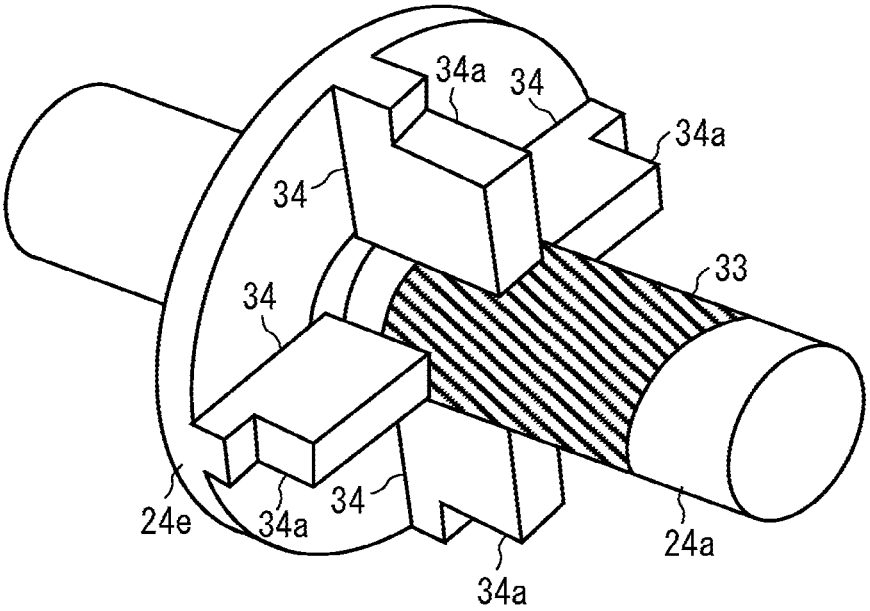
FIG. 6 is a schematic view illustrating a flange and a paddle used in a third embodiment of the present disclosure.

FIG. 6 illustrates a third embodiment of the present disclosure. The third embodiment is different from the above-described first embodiment in that the support shaft 24*a* has a heat dissipating part 33 and paddles 34 are used instead of the paddles 31, and other configurations are the same. The heat dissipating part 33 is made of a metal such as copper or aluminum having a good heat radiating property, and the support shaft 24*a* made of resin is inserted into the heat dissipating part 33 in the present embodiment. The heat dissipating part 33 disposed as described above contacts the developer entering the space between the flange 24*e* and the bearing 29 and can release the heat accumulated in the developer to prevent the occurrence of the above-described abnormal images.

As illustrated in FIG. 6, four paddles 34 are provided and radially formed from the axis of the support shaft 24*a* to face each other, that is, to be arranged in two straight lines. The paddle 34 has the cutout 34*a* at the tip corner to avoid contact with the outer circumferential portion of the bearing 29. Each paddle 34 supports the support shaft 24*a* via the heat dissipating part 33 and is integrally fixed to the support shaft 24*a*.

The above-described configuration can obtain the same advantage as the first embodiment and further prevents the occurrence of the abnormal images due to the effect of the heat dissipating part 33. Although disposing the heat dissipating part 33 reduces the strength of the support shaft 24*a*, the above-described configuration can reinforce the support shaft 24*a* because each paddle 34 is arranged to support the support shaft 24*a*, and the heat dissipating part 33 is sandwiched by the paddle 34 and a part of the support shaft 24*a* on which the heat dissipating part 33 is formed.

In the present embodiment, at least two paddles 34 may be provided in order to reinforce the support shaft 24*a*, and three or more paddles 34 may be provided. In addition, any configuration may be adopted as long as the paddle 32 is fixed to the flange 24*e*.

In each of the embodiments described above, although the collecting screw 24 as the developer conveyor has the flange 24*e* and the paddle 31, 32, or 34 as the developer mover at the right end portion in FIG. 2, the collecting screw 24 may have the flange 24*e* and the developer mover at a left end portion in FIG. 2, and the supply screw 26 as the developer conveyor may have the flange 24*e* and the developer mover at each of both end portions. If the developing device includes another developer conveyor in addition to the collecting screw 24 and the supply screw 26, another developer conveyor may have the flange and the developer mover at each of the both end portions.

In the above-described embodiments, the monochrome printer 1 is described as an example of an image forming apparatus, but the image forming apparatus is not limited this. The present disclosure is adoptable to a copier, a facsimile machine, a multifunction peripheral (MFP), and color image forming apparatuses. In the above-described embodiments, the image is formed on the sheet S as a recording medium on which the image is formed. The sheet S may be thick paper, a postcard, an envelope, plain paper, thin paper, coated paper (e.g., art paper), tracing paper, an overhead projector (OHP) transparency sheet (or OHP film), a resin film, and any other sheet-shaped material to bear an image.

Some embodiments of the present disclosure have been described above. However, embodiments of the present disclosure are not limited to the above-described embodiments, and various modifications and changes can be made within a range of the gist of the present disclosure recited in the scope of claims. The advantages achieved by the embodiments described above are examples and therefore are not limited to those described above.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A developing device, comprising:

a rotatable developer conveyor configured to convey a developer;

a bearing rotatably supporting a support shaft of the developer conveyer, the support shaft passing through the bearing;

a flange disposed at an end portion of the developer conveyor to regulate a movement of the developer in an axial direction of the developer conveyor;

a seal, disposed on the bearing and facing against the flange, to prevent the developer from entering between the support shaft and the bearing; and a protrusion projecting from a surface of the flange that faces the bearing and projecting from a surface of the support shaft, the protrusion configured to move the developer that enters between the flange and the bearing.

2. The developing device according to claim 1, wherein the protrusion is a ridge formed on the surface of the flange that faces the bearing.

3. The developing device according to claim 1, further comprising a plurality of protrusions including the protrusion.

4. The developing device according to claim 1, wherein the protrusion has a curved shape.

5. The developing device according to claim 1, wherein the support shaft includes a heat dissipating part configured to release heat, and the protrusion is configured to reinforce the heat dissipating part.

6. A process cartridge comprising:

an image bearer; and the developing device according to claim 1 configured to supply the developer to the image bearer.

7. An image forming apparatus comprising:

an image forming section, including the developing device according to claim 1, configured to form an image.

8. A developer container, comprising:

a reservoir to contain a developer;

a rotatable shaft configured to rotate inside the developer;

a bearing rotatably supporting the rotatable shaft;

a flange disposed at an end portion of the rotatable shaft to regulate a movement of the developer in an axial direction of the rotatable shaft;

a seal to prevent the developer from entering the bearing; and a protrusion projecting from a surface of the flange that faces the bearing and projecting from a surface of the rotatable shaft, the protrusion configured to move the developer that enters between the flange and the bearing.

9. The developer container of claim 8, wherein the protrusion is a ridge formed on the surface of the flange that faces the bearing.

10. The developer container of claim 8, further comprising a plurality of protrusions including the protrusion.

11. The developer container of claim 8, wherein the protrusion has a curved shape.

12. The developer container of claim 8, wherein the support shaft includes a heat dissipating part configured to release heat, and the protrusion is configured to reinforce the heat dissipating part.

13. An image forming apparatus, comprising:

an image forming section including the developer container of claim 8 and configured to form an image.

14. A developing device, comprising:

a rotatable developer conveyor configured to convey a developer;

a bearing rotatably supporting a support shaft of the developer conveyer;

a flange disposed at an end portion of the developer conveyor to regulate a movement of the developer in an axial direction of the developer conveyor; and a protrusion projecting from a surface of the flange that faces the bearing and projecting from a surface of the support shaft, the protrusion configured to move the developer that enters between the flange and the bearing, wherein no portion of the bearing surrounds the protrusion.

15. The developing device of claim 14, further comprising:

a seal, disposed on the bearing and facing against the flange, to prevent the developer from entering between the support shaft and the bearing.

* * * * *